US006083125A

United States Patent [19]

West

[11] Patent Number: 6,083,125

[45] Date of Patent: Jul. 4, 2000

[54] SPORTS RACQUET WITH OFFSET ANGLED HANDLE

[76] Inventor: David W. West, 242 Stanwich Rd., Riverside, Conn. 06830

[21] Appl. No.: 09/204,037

[22] Filed: Dec. 1, 1998

[51] Int. Cl.[7] ..... A63B 49/08

[52] U.S. Cl. ..... 473/549; 47/551; 47/552; 47/531; 47/526

[58] Field of Search ..... 473/549, 551, 473/531, 538, 526, 552

[56] References Cited

U.S. PATENT DOCUMENTS

| | | | |
|---|---|---|---|
| 3,545,755 | 12/1970 | Owada | 473/526 |
| 4,147,348 | 4/1979 | Lee | 473/526 |
| 4,659,080 | 4/1987 | Stoller | 473/526 |
| 4,743,021 | 5/1988 | Gonzales, Jr. | 473/526 |
| 4,759,546 | 7/1988 | Steele, Jr. | 473/526 |

FOREIGN PATENT DOCUMENTS

| | | | |
|---|---|---|---|
| 2576219 | 7/1986 | France | 473/FOR 183 |
| 2623092 | 5/1989 | France | 473/FOR 183 |
| 2626482 | 8/1989 | France | 473/FOR 183 |
| 3627953 | 3/1988 | Germany | 473/FOR 183 |
| 3929972 | 3/1991 | Germany | 473/FOR 183 |
| 4329075 | 3/1994 | Germany | 473/FOR 183 |

*Primary Examiner*—Raleigh W. Chiu

[57] ABSTRACT

The present invention provides a hand held racquet having a racquet face for striking a ball, and having at least one mirror plane intersecting the planar surface, a shaft assembly connected to the racquet face and a handle assembly connected to the shaft assembly, having a grip portion designed to be grasped by the hand of the user. The grip portion has a longitudinal axis and a grip center, wherein the longitudinal axis intersects the mirror plane at an angle of about 5° to 17°, substantially in the plane of the racquet face. The grip center is substantially in a mirror plane, and the grip portion incorporates at least one surface which is substantially parallel to the racquet face. The present invention also provides a hand held racquet wherein the handle assembly is connected in a manner fiat enables the angle of intersection between the longitudinal axis of the grip portion and the mirror plane to be adjusted in a rang of about 1° to 90°.

15 Claims, 4 Drawing Sheets

SPORTS RACQUET WITH OFFSET ANGLED HANDLE

BACKGROUND OF THE INVENTION (1) Field of the Invention

This invention applies to the field of sporting equipment, specifically to hand held racquets which are used to strike a ball, (e.g., tennis, racquetball, paddleball, and squash), and more specifically, to the grip these racquets employ.

(2) Description of Related Art

The design of conventional racquet handles which employ a grip that is in line with the racquet shaft and with a cross section that is an elongated octagon, (see FIG. 1*a*) is flawed in a number of respects for maximizing effectiveness and comfort of play. The most important drawback relates to the position of the wrist when striking the ball. If one imagines that the shaft of the racquet is a linear extension of the forearm, the hand must be angled at almost 90° to achieve an in-line position with the shaft (see FIG. 3*a*). This bent wrist position is suboptimal from the standpoint of generating leverage and thus power while striking the ball and therefore causes undue stress on the wrist and forearm during extended play.

U.S. Pat. No. 4,759,546 describes a racquet handle which incorporates a grip that is a) connected to the shaft at an angle of 13.5° (+/−4°), b) is connected in an offset manner that enables the center of the grip to be in line with the equilibrium axis of the racquet, and c) is uniquely contoured to facilitate rotational movement in the hand. (See FIGS. 2*a* & 2*b*).

While U.S. Pat. No. 4,759,546 elucidates a number of advantages of the described design over a conventional straight shaft/handle combination, this inventor believes it to be suboptimal regarding the described angle of the grip, and impractical from the standpoint of marketability, given the substantial departure from conventional straight-shaft. Also, at modest angles of intersection (less than about 17°) lacking the standard octagonal grip, it fails to provide the standard non-visual feedback regarding the cant of the racquet face. This is because with a conventional grip, the broad side of the octagon, which is parallel to the surface of the racquet, serves to cue the user regarding the striking angle of the racquet face without looking at it

SUMMARY OF THE INVENTION

Figure 1A:
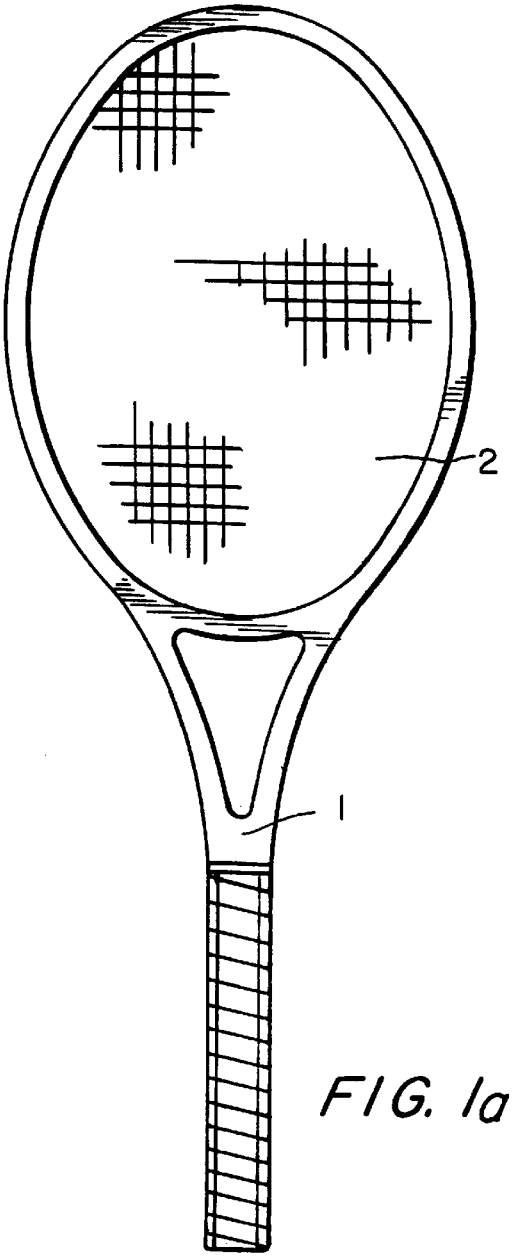
FIG. 1*a* depicts a tennis racket of conventional design having a shaft 1 and racket face 2.
Figure 1B:
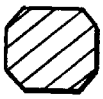
FIG. 1*b* depicts the cross section of the grip of the racket of FIG. 1*a*.

The present invention provides for a hand held racquet comprising a) a racquet face having a planar surface for striking a ball, and having at least one mirror plane intersecting the planar surface, b) a shaft assembly connected to the racquet face and c) a handle assembly operatively connected to the racquet shaft, having a grip portion designed to be grasped by the hand of the user, the grip portion having a longitudinal axis and a grip center, wherein the longitudinal axis intersects the mirror plane at an angle of about 1° to 90°, substantially in the plane of the racquet face, the grip center is substantially in a mirror plane, and wherein the grip portion incorporates at least one surface which is substantially parallel to the racquet face. One embodiment of the present invention is depicted in FIG. 1*c*. The racket has a racquet face with one mirror plane 3, amd a longitudinal center axis of the shaft assembly 4.

The longitudinal axis of the grip 5 may intersect the mirror plane 3 at an angle of about 5° to 17°, 4(see FIG. 1*c*). The sweet spot 6 of the racquet face preferably lies symmetrically along the mirror plane 3. While the grip may be of various shape, it is preferable that the cross section of the grip is substantially octagonal (see FIG. 1*d*).

Figure 5A:
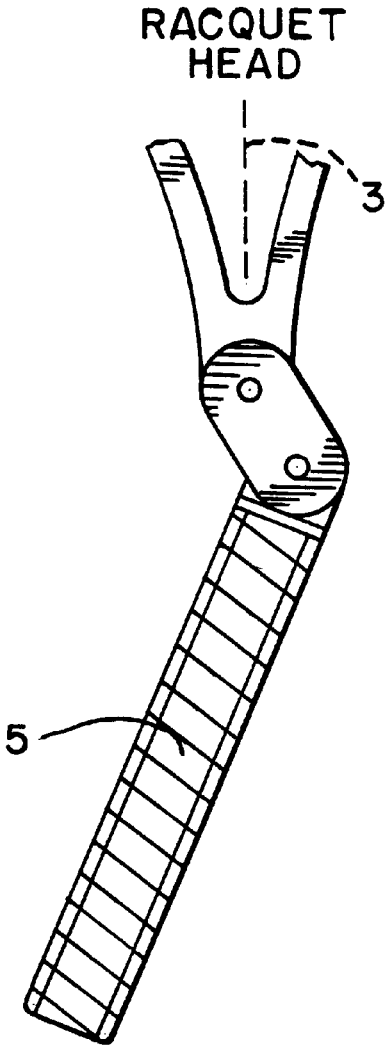
FIG. 5*a* depicts an embodiment of the present invention that can adjust the offset angle of the grip.
Figure 5B:
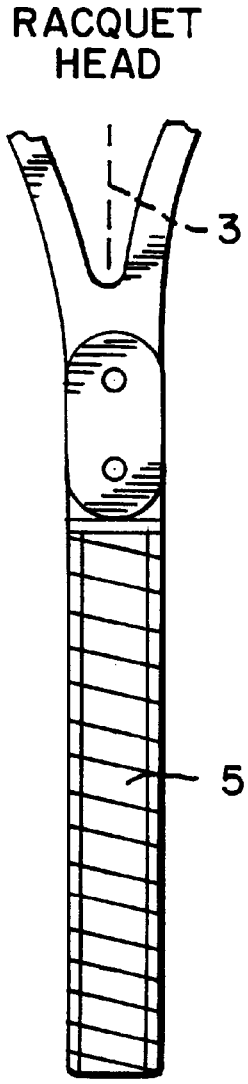
FIG. 5*b* depicts a racket handle of the present invention where the grip has been adjusted to align with the longitudinal center axis of the shaft.

As one embodiment of the present invention, the hand held racquet handle assembly is connected in a manner that enables the angle of intersection between the longitudinal axis of the grip 5 and the mirror plane 3 to be adjusted (see FIGS. 5*a* & 5*b*).

The present invention also provides for a hand held racquet comprising a racquet face having a generally planar surface for striking a ball (the racquet face), a shaft assembly connected to the racquet face, the shaft having a longitudinal center axis, and a handle assembly operatively connected to the racquet shaft, having a grip portion designed to be grasped by the hand of the user, the grip portion having a longitudinal axis and a grip center, wherein the grip center is substantially in the shaft's longitudinal center axis, and the grip's longitudinal axis intersects the shaft's longitudinal center axis at an angle of about 1° to 90° substantially in the plane of the racquet face, and wherein the cross section of the grip portion incorporates at least one surface which is substantially parallel to the racquet face. The longitudinal axis of the grip may intersects the shaft's longitudinal center axis at an angle of about 5° to 17° (see FIG. 1*c*). While the grip may be of various shape, it is preferable that the cross section of the grip is substantially octagonal (see FIG. 1*d*). The handle assembly may be connected in a manner that enables the angle of intersection between the longitudinal axes of the grip and the longitudinal center axis of the shaft to be adjusted.

The present invention also provides for a hand held racquet comprising a racquet face having a generally planar surface for striking a ball (the racquet face) a shaft assembly connected to the racquet face, the racquet face having a sweet spot with at least one mirror plane and a handle assembly operatively connected to the racquet shaft, having a grip portion designed to be grasped by the hand of the user, the grip portion having a longitudinal axis and a central grip point, wherein the central grip point is substantially in the mirror plane of the sweet spot, and the grip's longitudinal axis intersects the mirror plane of the sweet spot at an angle of about 1° to 90°, substantially in the plane of the racquet face, and wherein the grip portion incorporates at least one surface which is substantially parallel to the racquet face.). While the grip may be of various shapes, it is preferable that the cross section of the grip is substantially octagonal.

Figure 1D:
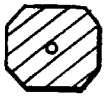
FIG. 1*d* depicts the cross section of the grip of the racket of FIG. 1*c*.
Figure 1C:
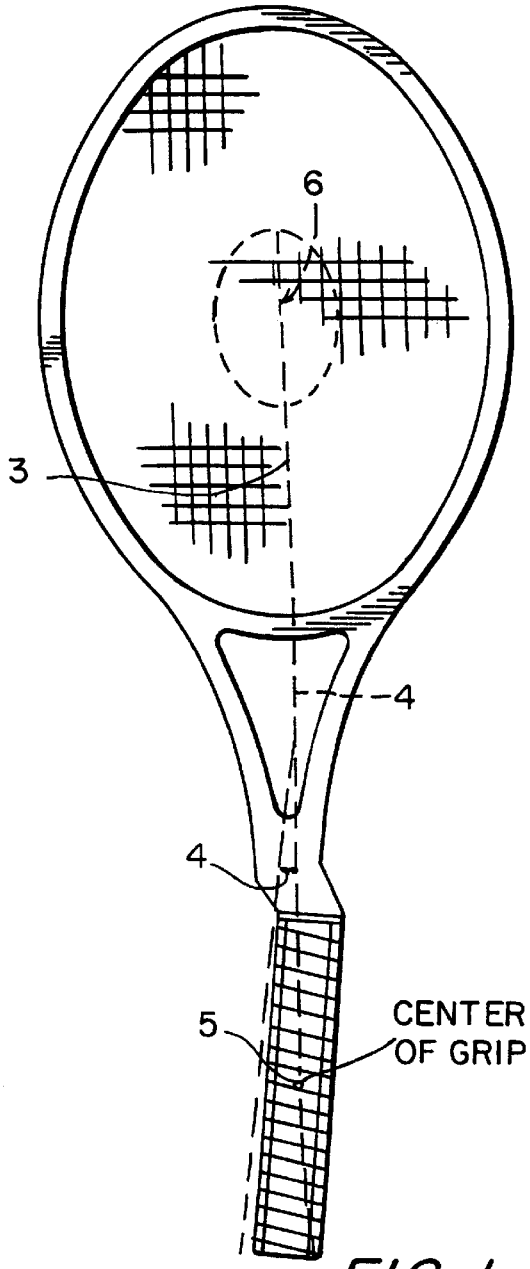
FIG. 1*c* depicts a tennis racket of the present invention.
Figures 2A, 2B:
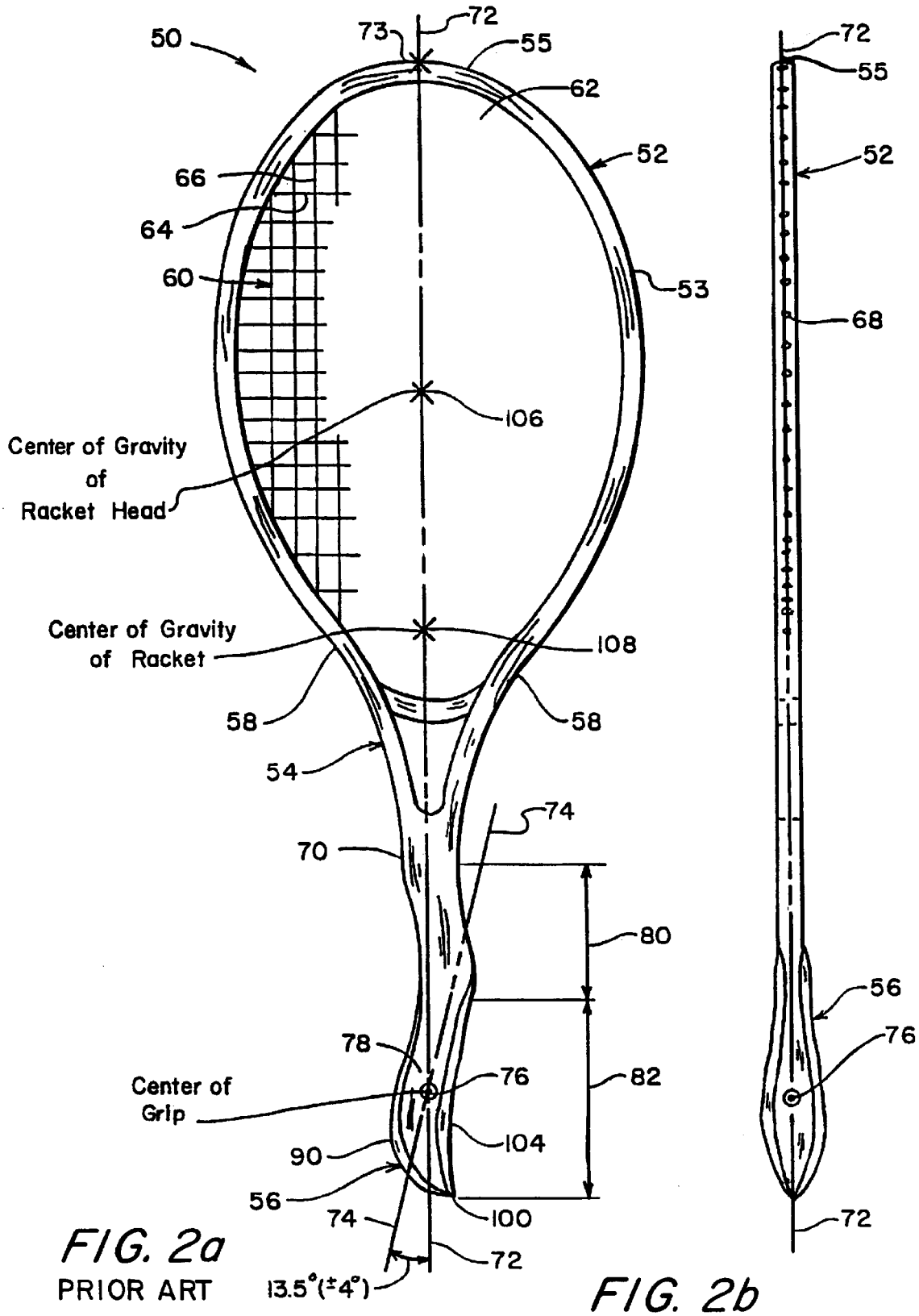
FIG. 2a PRIOR ART
FIG. 2b PRIOR ART
FIG. 2*a* depicts a tennis racket design taught in U.S. Pat. No. 4,759,546.
FIG. 2*b* depicts the side view of the tennis racket of FIG. 2*a*.

The longitudinal axis of the grip 5 may intersect the mirror plane of the sweet spot at an angle of about 5° to 17°, and the cross section of the grip may be substantially octagonal (see FIG. 1*c* & 1*d*). The handle assembly may be connected in a manner that enables the angle of intersection between the longitudinal axes of the grip and the mirror plane of the sweet spot to be adjusted.

The present invention also provides for a hand held racquet comprising a racquet face having a planar surface for striking a ball (the racquet face), and having at least one mirror plane intersecting the planar surface, a shaft assembly connected to the racquet face and a handle assembly operatively connected to the racquet shaft, having a grip portion designed to be grasped by the hand of the user, the grip portion having a longitudinal axis and a grip center, wherein the longitudinal axis intersects the mirror plane at an angle of about 1° to 90°, substantially in the plane of the racquet face, the grip center is substantially in a mirror plane, and wherein the grip portion is shaped in a manner which enables enhanced leverage to be applied to the racquet while initiating the swing. The longitudinal axis of the grip may intersect the mirror plane 4 at an angle of about 16° to 90° (see FIG. 4*a*). In one embodiment, the cross-section of the grip is broadened along a line perpendicular to the grip's longitudinal axis 7 (see FIG. 4*b*). The cross section of the grip may be broadened along a line perpendicular to the grip's longitudinal axis (see FIG. 4*b*).

The handle assembly may be connected in a manner that enables the angle of intersection between the longitudinal axes of the grip and the mirror plane to be adjusted.

The present invention further provides for a hand held racquet comprising a racquet face having a generally planar surface for striking a ball (the racquet face), a shaft assembly connected to the racquet face, the shaft having a longitudinal center axis, and a handle assembly operatively connected to the racquet shaft, having a grip portion designed to be grasped by the hand of the user, the grip portion having a longitudinal axis and a grip center, wherein the grip center is substantially in the shaft's center axis longitudinal center axis, and the grip's longitudinal axis intersects the shaft's longitudinal at an angle of about 1° to 90° substantially in the plane of the racquet face, and wherein the grip portion is shaped in a manner which enables enhanced leverage to be applied to the racquet while initiating the swing.

Figure 4A:
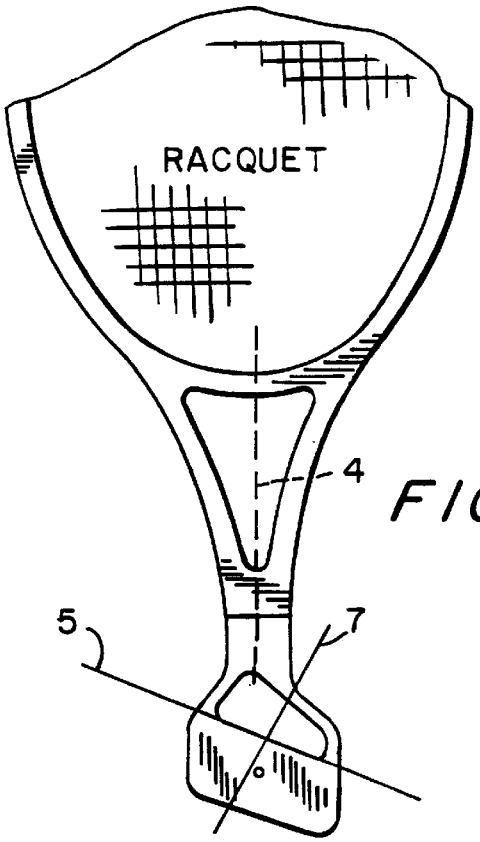
FIG. 4*a* depicts an alternative grip to a tennis racket of the present invention.

The longitudinal axis of the grip 5 may intersect the shaft's longitudinal center axis 4 at an angle of about 17° to 90° (see FIG. 4*a*). The cross section of the grip may be broadened in the direction perpendicular to the grip's longitudinal axis 7 (see FIG. 4*b*). Further, the handle assembly may be connected in a manner that enables the angle of intersection between the longitudinal axis of the grip and the shaft's longitudinal center axis to be adjusted.

The present invention further provides for a hand held racquet comprising a racquet face having a generally planar surface for striking a ball (the racquet face), a shaft assembly connected to the racquet face, the racquet face having a sweet spot with at least one mirror plane and a handle assembly operatively connected to the racquet shaft, having a grip portion designed to be grasped by the hand of the user, the grip portion having a longitudinal axis and a central grip point, wherein the central grip point is substantially in the mirror plane of the sweet spot, and the grip's longitudinal axis intersects the mirror plane of the sweet spot at an angle of about 1° to 90°, substantially in the plane of the racquet face, and wherein the grip portion is shaped in a manner which enables enhanced leverage to be applied to the racquet while initiating the swing.

The longitudinal axis of the grip 5 may intersect the mirror plane of the sweet spot 4 at an angle of about 17° to 90° (see FIG. 4*a*). The cross section of the grip may be broadened in a direction perpendicular to the grip's longitudinal axis 7 (see FIG. 4*b*). The longitudinal axis of the grip may intersect the mirror plane of the sweet spot at an angle of about 17° to 90°, and the grip may be broadened in a direction perpendicular to the grip's longitudinal axis (see FIGS. 4*a* & 4*b*). The handle assembly may be connected in a manner that enables the angle of intersection between the longitudinal axis of the grip and the mirror plane of the sweet spot to be adjusted.

DETAILED DESCRIPTION OF THE INVENTION

Figure 3A:
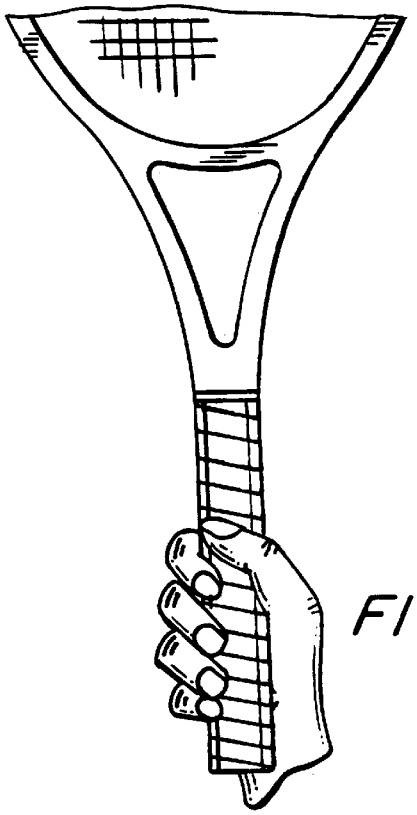
FIG. 3*a* depicts the position of a player's hand holding a tennis racket of conventional design.
Figure 3B:
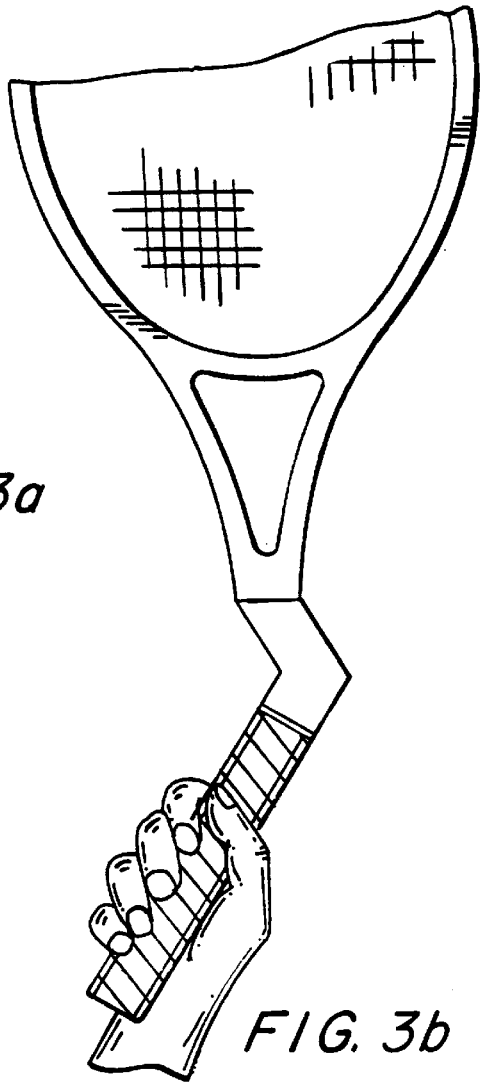
FIG. 3*b* depicts the position of a player's hand holding a tennis racket of the present invention

This invention addresses a number of the problems that exist with straight shaft racquet handles. By attaching the handle to the shaft at an angle, the need to angle one's wrist is reduced (see FIGS. 3*a* & *b*). Offsetting the base of the handle where it is attached to the shaft allows the grip center point to be placed substantially in the racquet's plane of symmetry, or mirror plane (see FIG. 1*c*), preventing the torque that would be imposed on the shaft and forearm without such a feature. Further, by incorporating a plane on the surface of the grip that is parallel with the plane of the racquet face, or even better, the conventional quasi-octagonal grip shape, which includes two planes parallel to the racquet face, and by employing either a handle with a modest angle of intersection (1° to 15°) or a handle designed with adjustability in the angle of intersection, it is believed that the commercial marketability of this invention will be significantly superior to prior art.

A number of sports employ racquets which can generally be described as oval or similarly shaped structures which surround an effectively planar surface created by strings tightly stretched within the structure, with a shaft extending from the structure that the user holds in his hand to swing the racquet while engaged in sport. At the end of the shaft, which may take a number of forms, there is a handle, otherwise known as a grip, which generally consists of the 4"–8" of the shaft furthermost from the face of the racquet. This handle is generally covered with a material that helps increase friction with the hand of the person using it, and is a geometric prism with the longitudinal vertices positioned such the circumference of the cross section is a slightly elongated octagon (see FIG. 1*b*) Angling the handle with the shat, as referred to in the above paragraph, specifically means that the longitudinal axis of the handle, rather than being in a straight line with the longitudinal axis of the shaft, is attached in a manner such that the axes of the shaft and handle intersect at an angle of deviation which is substantially in the plane of the face of the racquet The grip center mentioned in the first paragraph of the detailed description of the invention section, refers to the general area at the center of mass of the portion of the grip that comes in contact with the hand during play. The offset at the base of the handle, where the handle is attached to the shaft, can be achieved in a number of ways to enable the center of the grip to be substantially in either the racquet's primary plane of symmetry, or the longitudinal center line of the shaft If neither such line exists, the grip center would be in the primary line of symmetry of the sweet spot of the racquet face. The racquet's plane of symmetry, or mirror plane, in a conventional racquet, is the line extending through the middle of the racquet face and the top of the shaft such that the left and right sides of the racquet face are substantially mirror images of one another (see FIG. 1*c* ). The "sweet spot" is the zone on the surface of the racquet within which striking the ball creates no objectionable vibration or tortional stress on the hand, wrist, or forearm.

As is the case with many innovations, value is not created for consumers unless the innovation is met with commercial success. When dealing with consumer products, lack of familiarity and the risk associated with spending money on an unproven concept can be significant obstacles to commercial success. For this reason retaining the familiar substantially octagonal cross section grip conventionally employed on racquet grips is an important element of a preferred embodiment of this invention. The familiar shape diminishes the hurdles that potential customers must overcome in the initial process of adopting the innovative angle without introducing an unnecessarily foreign, awkward looking appearance as with prior inventions. Further, the conventional octagonal shape, and relatively small angles of intersection between the grip and shaft, enable the user to employ a variety of styles of gripping the handle that is much like those employed when gripping a straight shaft handle. Additionally, handles which allow the angle to be adjusted from 0° to as much as 90° will let users try the new concept with less risk, and a.) to gradually adapt to progressively greater angles of deviation, and b.) to find the optimum angle for their personal style of play.

Figure 4B:
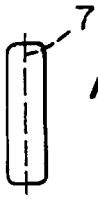
FIG. 4*b* depicts the cross section of the grip of the racket of FIG. 4*b*.

In another preferred embodiment of this invention, the grip is angled more acutely against the shaft, and since a conventional grip angled above about 17° would tend to twist in the hand of the user as he/she initiates the swing, the grip is widened to provide the leverage needed to generate power behind the swing (see FIGS. 4*a* & 4*b*).

The invention is not limited by the embodiments described above which are presented as examples only but can be modified in various ways within the scope of protection defined by the appended patent claims. All references referred to herein are incorporated by reference.

What is claimed is:

1. A hand held racquet comprising a racquet face having a planar surface or striking a ball, and having at least one mirror plane intersecting the planar surface, a shaft assembly connected to the racquet face and a handle assembly operatively connected to the shaft assembly, having a grip portion designed to be grasped by the hand of the user, the grip portion having a longitudinal axis and a grip center, wherein the longitudinal axis intersects the mirror plane at an angle of about 5° to 17°, substantially in the plane of the racquet face, the grip center is substantially in a mirror plane, and wherein the grip portion incorporates at least one surface which is substantially parallel to the racquet face.

2. The hand held racquet according to claim 1, wherein the cross section of the grip portion is substantially octagonal.

3. A hand held racquet comprising a racquet face having a planar surface for striking a ball, and having at least one mirror plane intersecting the planar surface, a shaft assembly connected to the racquet face and a handle assembly operatively connected to the shaft assembly, having a grip portion designed to be grasped by the hand of the user, the grip portion having a longitudinal axis and a grip center, wherein the longitudinal axis intersects the mirror plane at an angle of about 1° to 90°, substantially in the plane of the racquet face, the grip center is substantially in a mirror plane, wherein the grip portion incorporates at least one surface which is substantially parallel to the racquet face, and wherein the handle assembly is connected in a manner that enables the angle of intersection between the longitudinal axis of the grip portion and the mirror plane to be adjusted.

4. A hand held racquet comprising a racquet face having a generally planar surface for striking a ball, a shaft assembly connected to the racquet face, the shaft assembly having a longitudinal center axis, and a handle assembly operatively connected to the racquet shaft, having a grip portion designed to be grasped by the hand of the user, the grip portion having a longitudinal axis and a grip center, wherein the grip center is substantially in the shaft assembly longitudinal center axis, and the grip portion longitudinal axis intersects the shaft assembly longitudinal center axis at an angle of about 5° to 17°, substantially in the plane of the racquet face, and wherein the cross section of the grip portion incorporates at least one surface which is substantially parallel to the racquet face.

5. The hand held racquet according to claim 4, wherein the cross section of the grip portion is substantially octagonal.

6. A hand held racquet comprising a racquet face having a generally planar surface for striking a ball, a shaft assembly connected to the racquet face, the shaft assembly having a longitudinal center axis, and a handle assembly operatively connected to the racquet shaft, having a grip portion designed to be grasped by the hand of the user, the grip portion having a longitudinal axis and a grip center, wherein the grip center is substantially in the shaft assembly longitudinal center axis, and the grip portion longitudinal axis intersects the shaft assembly longitudinal center axis at an angle of about 1° to 90°, substantially in the plane of the racquet face, and wherein the cross section of the grip portion incorporates at least one surface which is substantially parallel to the racquet face, wherein the handle assembly is connected in a manner that enables the angle of intersection between the longitudinal axis of the grip portion and the longitudinal center axis of the shaft assembly to be adjusted.

7. A hand held racquet comprising a racquet face having a generally planar surface for striking a ball, a shaft assembly connected to the racquet face, the racquet face having a sweet spot with at least one mirror plane and a handle assembly operatively connected to the racquet shaft, having a grip portion designed to be grasped by the band of the user, the grip portion having a longitudinal axis and a central grip point, wherein the central grip point is substantially in the mirror plane of the sweet spot, and the grip portion longitudinal axis intersects the mirror plane of the sweet spot at an angle of about 5° to 17°, substantially in the plane of th racquet face, an wherein the grip portion incorporates at least one surface which is substantially parallel to the racquet face.

8. The hand held racquet according to claim 7, wherein the cross section of the grip portion is substantially octagonal.

9. A hand held racquet comprising a racquet face having a generally planar surface for striking a ball, a shaft assembly connected to the racquet face, the racquet face having a sweet spot with at least one mirror plane and a handle assembly operatively connected to the racquet shaft, having a grip portion designed to be grasped by the hand of the user, the grip portion having a longitudinal axis and a central grip point, wherein the central grip point is substantially in the mirror plane of the sweet spot, and the grip portion longitudinal axis intersects the mirror plane of the sweet spot at an angle of about 1° to 90°, substantially in the plane of the racquet face, and wherein the grip portion incorporates at least one surface which is substantially parallel to the racquet face, wherein the handle assembly is connected in a manner that enables the angle of intersection between the longitudinal axis of the grip portion and the mirror plane of the sweet spot to be adjusted.

10. A hand held racquet comprising a racquet face having a planar surface for striking a ball, and having at least one mirror plane intersecting the planar surface, a shaft assembly connected to the racquet face and a handle assembly operatively connected to the racquet shaft, having a grip portion designed to be grasped by the hand of the user, the grip portion having a longitudinal axis and a grip center, wherein the longitudinal axis intersects the mirror plane at an angle of about 1° to 90°, substantially in the plane of the racquet face, the grip center is substantially in a mirror plane, wherein the grip portion is shaped in a manner which enables enhanced leverage to be applied to the racquet while initiating the swing, and wherein the handle assembly is connected in a manner that enables the angle of intersection between the longitudinal axis of the grip portion and the mirror plane to be adjusted.

11. A hand held racquet comprising a racquet face having a generally planar surface for striking a ball, a shaft assembly connected to the racquet face, the shaft having a longitudinal center axis, and a handle assembly operatively connected to the racquet shaft, having a grip portion designed to be grasped by the hand of the user, the grip portion having a longitudinal axis and a grip center, wherein the grip center is substantially in the shaft assembly longitudinal center axis, and the grip portion longitudinal axis intersects the shaft assembly longitudinal center axis at an angle of about 1° to 90°, substantially in the plane of the racquet face, wherein the grip portion is shaped in a manner which enables enhanced leverage to be applied to the racquet while initiating the swing, and wherein the handle assembly is connected in a manner that enables the angle of intersection between the longitudinal axis of the grip portion and the shaft assembly longitudinal center axis to be adjusted.

12. A hand held racquet according to claim 11, wherein the longitudinal axis of the grip intersects the shaft's longitudinal center axis at an angle of about 17° to 90°.

13. A hand held racquet according to claim 11, wherein the cross section of the grip is broadened in the direction perpendicular to the grip's longitudinal axis.

14. A hand held racquet according to claim 11, wherein the longitudinal axis of the grip intersects the shafts longitudinal center axis at an angle of about 17° to 90°, and wherein the cross section of the grip is broadened in a direction perpendicular to the grip's longitudinal axis.

15. A hand held racquet comprising a racquet face having a generally planar surface for striking a ball, a shaft assembly connected to the racquet face, the racquet face having a sweet spot with at least one mirror plane and a handle assembly operatively connected to the racquet shaft, having a grip portion designed to be grasped by the hand of the user, the grip portion having a longitudinal axis and a central grip point, wherein the central grip point is substantially in the mirror plane of the sweet spot, and the grip portion longitudinal axis intersects the mirror plane of the sweet spot at an angle of about 1° to 90°, substantially in the plane of the racquet face, wherein the grip portion is shaped in a manner which cable enhanced leverage to be applied to the racquet while initiating the swing, and wherein the handle assembly is connected in a manner that enables the angle of intersection between the longitudinal axis of the grip portion and the mirror plane of the sweet spot to be adjusted.

* * * * *